US006620568B2

(12) United States Patent
Nakamura et al.

(10) Patent No.: US 6,620,568 B2
(45) Date of Patent: Sep. 16, 2003

(54) FLASH FIXING COLOR TONER AND IMAGE FORMING PROCESS USING THE SAME

(75) Inventors: Yasushige Nakamura, Kawasaki (JP); Shinichi Yaoi, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/874,050

(22) Filed: Jun. 6, 2001

(65) Prior Publication Data

US 2002/0072004 A1 Jun. 13, 2002

(30) Foreign Application Priority Data

Dec. 13, 2000 (JP) ..... 2000-379344

(51) Int. Cl.[7] ..... G03G 9/097

(52) U.S. Cl. ..... 430/108.21; 430/108.1; 430/108.15; 430/108.24; 430/108.5; 430/124

(58) Field of Search ..... 430/108.1, 108.21, 430/108.2, 108.24, 108.14, 108.5, 108.11, 108.15, 97, 124, 106, 110

(56) References Cited

U.S. PATENT DOCUMENTS 5,362,592 A * 11/1994 Murofushi et al. ..... 430/108.2
5,432,035 A 7/1995 Katagiri et al.

FOREIGN PATENT DOCUMENTS

| | | | |
|---|---|---|---|
| EP | 0 892 312 A2 | | 1/1999 |
| EP | 0 940 727 A1 | | 9/1999 |
| JP | 6-348056 | | 12/1994 |
| JP | 7-191492 | | 7/1995 |
| JP | 10-39535 | | 2/1998 |
| JP | 11-38666 | | 2/1999 |
| JP | WO99/13382 | | 3/1999 |
| JP | 11-125928 | | 5/1999 |
| JP | 11-125929 | | 5/1999 |
| JP | 11-125930 | | 5/1999 |
| JP | 2000-35689 | | 2/2000 |
| JP | 2000-147824 | | 5/2000 |
| JP | 2000-155439 | | 6/2000 |
| JP | 2000-352835 | * | 12/2000 |

OTHER PUBLICATIONS

Japanese Patent Office Partial Machine–Assisted Translation of JP 2000–352835, Paragraphs 0001–0055 and 0081–0088, claims 1 and 2, Dec. 2000.*

US. Patent & Trademark Office English–Language Translation of JP 12–352835 (2000–352835) (pub Dec. 2000).*

* cited by examiner

*Primary Examiner*—Janis L. Dote
(74) *Attorney, Agent, or Firm*—Armstrong, Westerman & Hattori, LLP.

(57) ABSTRACT

The present invention discloses a flash fixing color toner for use in an image forming process, which comprises a binder resin, a coloring agent, and an infrared absorbent, wherein negative ions form part of the infrared absorbent, and the negative ions include toluenesulfonic acid ion ($C_6H_4(CH_3)SO_3^-$), nitric acid ion ($NO_3^-$) or hexafluorophosphoric acid ion ($PF_6^-$). Further, the present invention discloses an image forming process, which is characterized by using the flash fixing color toner.

5 Claims, 4 Drawing Sheets

FIG.2

| | DIIMMONIUM BASED | | | | | | | | | |
|---|---|---|---|---|---|---|---|---|---|---|
| | DIIMMONIUM1 | DIIMMONIUM2 | DIIMMONIUM3 | DIIMMONIUM4 | DIIMMONIUM5 | DIIMMONIUM6 | DIIMMONIUM7 | DIIMMONIUM8 | DIIMMONIUM9 | DIIMMONIUM10 |
| R1 | $C_2H_5$ | $C_2H_5$ | $C_2H_5$ | $C_2H_5$ | $C_2H_5$ | $C_2H_5$ | $C_2H_5$ | $C_2H_5$ | $CH_3$ | $CH_3$ |
| R2 | $C_2H_5$ | $C_2H_5$ | $C_2H_5$ | $C_2H_5$ | $C_2H_5$ | $C_2H_5$ | $C_2H_5$ | $C_2H_5$ | $CH_3$ | $CH_3$ |
| R3 | $C_2H_5$ | $C_2H_5$ | $C_2H_5$ | $C_2H_5$ | $C_2H_5$ | $C_2H_5$ | $C_2H_5$ | $C_2H_5$ | $C_2H_5$ | $C_2H_5$ |
| R4 | $C_2H_5$ | $C_2H_5$ | $C_2H_5$ | $C_2H_5$ | $C_2H_5$ | $C_2H_5$ | $C_2H_5$ | $C_2H_5$ | $C_2H_5$ | $C_2H_5$ |
| $X^-$ | TOLUENESULFONIC ACID ION | $NO_3^-$ | $PF_6^-$ | $ClO_4^-$ | $BF_6^-$ | $SbF_6^-$ | $PO_4^{2-}$ | $SO_4^{2-}$ | $Cl^-$ | $ClO_4^-$ |

FIG.3

| | AMINIUM BASED | | | | | | | |
|---|---|---|---|---|---|---|---|---|
| | AMINIUM1 | AMINIUM2 | AMINIUM3 | AMINIUM4 | AMINIUM5 | AMINIUM6 | AMINIUM7 | AMINIUM8 |
| A | PHENYLENE | PHENYLENE | PHENYLENE | PHENYLENE | PHENYLENE | PHENYLENE | PHENYLENE | PHENYLENE |
| R1 | $C_2H_5$ | $C_2H_5$ | $C_2H_5$ | $C_2H_5$ | $C_2H_5$ | $C_2H_5$ | $C_2H_5$ | $C_2H_5$ |
| R2 | $C_2H_5$ | $C_2H_5$ | $C_2H_5$ | $C_2H_5$ | $C_2H_5$ | $C_2H_5$ | $C_2H_5$ | $C_2H_5$ |
| R3 | $C_2H_5$ | $C_2H_5$ | $C_2H_5$ | $C_2H_5$ | $C_2H_5$ | $C_2H_5$ | $C_2H_5$ | $C_2H_5$ |
| R4 | $C_2H_5$ | $C_2H_5$ | $C_2H_5$ | $C_2H_5$ | $C_2H_5$ | $C_2H_5$ | $C_2H_5$ | $C_2H_5$ |
| X | TOLUENESULFONIC ACID ION | $NO_3^-$ | $PF_6^-$ | $ClO_4^-$ | $BF_6^-$ | $SbF_6^-$ | $PO_4^{2-}$ | $SO_4^{2-}$ |

FIG.4

| | POLYMETHINE BASED | | | | | | | |
|---|---|---|---|---|---|---|---|---|
| | POLYMETHINE1 | POLYMETHINE2 | POLYMETHINE3 | POLYMETHINE4 | POLYMETHINE5 | POLYMETHINE6 | POLYMETHINE7 | POLYMETHINE8 |
| R1 | $C_2H_5$ | $C_2H_5$ | $C_2H_5$ | $C_2H_5$ | $C_2H_5$ | $C_2H_5$ | $C_2H_5$ | $C_2H_5$ |
| R2 | $C_2H_5$ | $C_2H_5$ | $C_2H_5$ | $C_2H_5$ | $C_2H_5$ | $C_2H_5$ | $C_2H_5$ | $C_2H_5$ |
| R3 | $C_2H_5$ | $C_2H_5$ | $C_2H_5$ | $C_2H_5$ | $C_2H_5$ | $C_2H_5$ | $C_2H_5$ | $C_2H_5$ |
| R4 | $C_2H_5$ | $C_2H_5$ | $C_2H_5$ | $C_2H_5$ | $C_2H_5$ | $C_2H_5$ | $C_2H_5$ | $C_2H_5$ |
| R5 | $C_2H_5$ | $C_2H_5$ | $C_2H_5$ | $C_2H_5$ | $C_2H_5$ | $C_2H_5$ | $C_2H_5$ | $C_2H_5$ |
| R6 | $C_2H_5$ | $C_2H_5$ | $C_2H_5$ | $C_2H_5$ | $C_2H_5$ | $C_2H_5$ | $C_2H_5$ | $C_2H_5$ |
| R7 | $C_2H_5$ | $C_2H_5$ | $C_2H_5$ | $C_2H_5$ | $C_2H_5$ | $C_2H_5$ | $C_2H_5$ | $C_2H_5$ |
| R8 | $C_2H_5$ | $C_2H_5$ | $C_2H_5$ | $C_2H_5$ | $C_2H_5$ | $C_2H_5$ | $C_2H_5$ | $C_2H_5$ |
| X | TOLUENESULFONIC ACID ION | $NO_3^-$ | $PF_6^-$ | $ClO_4^-$ | $BF_6^-$ | $SbF_6^-$ | $PO_4^{2-}$ | $SO_4^{2-}$ |

FIG.5

| | EX1 | EX2 | EX3 | EX4 | EX5 | EX6 | EX7 | EX8 | EX9 | EX10 |
|---|---|---|---|---|---|---|---|---|---|---|
| INFRARED ABSORBENT | DIIMMONIUM1 | DIIMMONIUM2 | DIIMMONIUM3 | DIIMMONIUM4 | DIIMMONIUM5 | DIIMMONIUM6 | DIIMMONIUM7 | DIIMMONIUM8 | DIIMMONIUM9 | DIIMMONIUM10 |
| LL CHARGE AMOUT (−μC/g) | 25.2 | 22.5 | 26.9 | 35.4 | 24 | 32 | 33.5 | 30.2 | 20.6 | 29.5 |
| HH CHARGE AMOUNT (−μC/g) | 20.5 | 20.5 | 25.0 | 10.2 | 5.3 | 14.5 | 5.2 | 2.1 | 1 | 14.2 |
| HH/LL RATIO | 81.3 | 91.1 | 92.9 | 28.8 | 22.1 | 45.3 | 15.5 | 7 | 4.9 | 48.1 |
| FIXING DEGREE(%) | 85 | 85 | 85 | 86 | 86 | 95 | 84 | 86 | 87 | 83 |
| OPTICAL DENSITY(LL/HH) | O/O | O/O | O/O | ×/O | O/O | ×/O | ×/O | ×/O | O/O | ×/O |
| FOGGING(LL/HH) | O/O | O/O | O/O | O/× | O/× | O/× | O/× | O/× | O/× | O/× |

FIG.6

| | EX11 | EX12 | EX13 | EX14 | EX15 | EX16 | EX17 | EX18 |
|---|---|---|---|---|---|---|---|---|
| INFRARED ABSORBENT | AMINIUM1 | AMINIUM2 | AMINIUM3 | AMINIUM4 | AMINIUM5 | AMINIUM6 | AMINIUM7 | AMINIUM8 |
| LL CHARGE AMOUT (−μC/g) | 25.2 | 25.4 | 27.5 | 33.2 | 23.2 | 32.9 | 32.1 | 29.5 |
| HH CHARGE AMOUNT (−μC/g) | 21 | 24.1 | 24.0 | 14.8 | 10.2 | 14 | 7.2 | 6.2 |
| HH/LL RATIO | 83.3 | 94.9 | 87.2 | 44.6 | 44 | 42.6 | 22.4 | 21 |
| FIXING DEGREE(%) | 86 | 85 | 89 | 83 | 87 | 88 | 83 | 84 |
| OPTICAL DENSITY(LL/HH) | O/O | O/O | O/O | ×/O | O/O | ×/O | ×/O | ×/O |
| FOGGING(LL/HH) | O/O | O/O | O/O | O/× | O/× | O/× | O/× | O/× |

FIG.7

| | EX19 | EX20 | EX21 | EX22 | EX23 | EX24 | EX25 | EX26 |
|---|---|---|---|---|---|---|---|---|
| INFRARED ABSORBENT | POLYMETHINE1 | POLYMETHINE2 | POLYMETHINE3 | POLYMETHINE4 | POLYMETHINE5 | POLYMETHINE6 | POLYMETHINE7 | POLYMETHINE8 |
| LL CHARGE AMOUT (−μC/g) | 25.2 | 25.4 | 27.5 | 33.2 | 23.2 | 32.9 | 32.1 | 29.5 |
| HH CHARGE AMOUNT (−μC/g) | 21 | 24.1 | 25.0 | 14.3 | 10.2 | 14 | 7.2 | 6.2 |
| HH/LL RATIO | 83.3 | 94.9 | 90.9 | 43.1 | 44 | 42.6 | 22.4 | 21 |
| FIXING DEGREE(%) | 85 | 87 | 84 | 89 | 85 | 86 | 86 | 82 |
| OPTICAL DENSITY(LL/HH) | O/O | O/O | O/O | ×/O | O/O | ×/O | ×/O | ×/O |
| FOGGING(LL/HH) | O/O | O/O | O/O | O/× | O/× | O/× | O/× | O/× |

FLASH FIXING COLOR TONER AND IMAGE FORMING PROCESS USING THE SAME

BACKGROUND OF THE INVENTION

1. Field of the Invention

The present invention generally relates to a flash fixing color toner that is used with an image forming process which is performed by an electrophotographic copier, facsimile or printer, and more particularly to a flash fixing color toner which is fixed to a recording medium by irradiation of flash light in an electrophotographic image forming process. Further, the present invention relates to an image forming process that uses the flash fixing color toner which is fixed to a recording medium by irradiation of flash light.

2. Description of the Related Art

In an electrophotographic image forming apparatus that employs flash light irradiation for fixing a toner onto a recording medium, the application of pressure to the toner is not needed for the fixing of the toner but it is necessary to make efficient use of the energy of flash light in the fixing or fusing of the toner onto the recording medium.

Generally, a color toner absorbs only part of an irradiation light energy, apart from a black toner. It has been observed that the light energy absorption properties of a color toner are lower than the light energy absorption properties of a black toner, and that the use of a color toner in a conventional flash fixation process often causes a defective fixing. However, in recent years, there is an increasing demand for a color image formation using an electrophotographic flash fixation process, which is capable of performing a high-speed operation and usable with a special recording medium having a step-like surface.

There are basically five major steps employed in the electrophotographic printing process: (1) charging a photoconductor electrostatically, (2) exposing the photoconductor to the imaging light pattern to create an electrostatic latent image thereon, (3) developing the photoconductor by bringing charged toner particles to the surface of the photoconductor to create a toner image thereon, (4) transferring the toner image from the photoconductor surface to a recording medium (e.g., paper), and (5) fixing or fusing the toner to the recording medium.

As is well known, among these steps of the electrophotographic printing process, the toner fixing step may be achieved by selecting one of the three methods: the heat roll method, the oven fixing method and the flash fixing method. The flash fixing method uses irradiation of light or infrared rays (flash light).

The heat roll method mentioned above is most commonly utilized. In the heat roll method, the fixing roller held at a high temperature applies heat and pressure directly to the toner so that the toner is fixed to the recording medium. With a simple, inexpensive configuration of the fixing roller used, the fixing surface can be made flat. However, there are several problems with the heat roll method. The recording medium (e.g., paper) after the toner fixing step is liable to be curled. The toner sticks to the surface of the fixing roller, and the recording medium is liable to being stained with such toner due to the offset. The recording medium and the fixing roller contact each other, and the transport of the recording medium in an image forming apparatus may be slanted from the desired direction. It is difficult to achieve high-speed image formation with the image forming apparatus. It is difficult that the heat roll method achieves the toner fixing of a special recording medium like a sticker post card.

The flash fixing method mentioned above is a non-contact toner fixing method, and the problems of the heat roller method such as the curling and the offset are eliminated. The high-speed image formation and the toner fixing of a special recording medium can easily be achieved with the flash fixing method. Accordingly, the application of the flash fixing method to high-speed printers and copiers for office use is increasing in recent years.

In the flash fixing method, a black toner or the like efficiently absorbs an irradiation light energy with respect to all the wavelengths. A thermal energy produced by irradiation of flash light will easily increase the temperature of the black toner to the desired level, and the particles of the black toner can be fused without difficulty. The toner fixing to the recording medium can easily be achieved in the case of the black toner or the like.

However, as described above, the light energy absorption properties of a color toner are lower than the light energy absorption properties of a black toner, and the use of a color toner in the conventional flash fixation process often causes a defective fixing. A thermal energy produced by irradiation of flash light does not increase the temperature of the color toner to a sufficiently high level, and the particles of the color toner cannot easily be fused. The toner fixing to the recording medium is not easily be achieved in the case of the color toner. The use of a color toner in the conventional flash fixation process is likely to cause a defective fixing (e.g., fogging).

As disclosed in International Publication No. WO99/13382 and Japanese Laid-Open Patent Application Nos.2000-147824, 7-191492, 2000-155439, 6-348056, 10-39535, 2000-35689, 11-38666, 11-125930, 11-125928, 11-125929, and 11-65167, the inclusion of an infrared absorbent in a flash fixing color toner has been proposed in order eliminate the above problem. In the conventional color toner, as disclosed in the above-mentioned documents, the use of the infrared absorbent provides the color toner with improved light energy absorption properties.

However, in the conventional color toner, only the positive ions of the infrared absorbent, which serve to improve the light energy absorption properties of the color toner, are considered. However, there is no teaching in the above-mentioned documents that the negative ions of the infrared absorbent, contained in the color toner, may affect the charged condition of the toner over an extended period of time, which will deteriorate the quality of a resulting color image.

In order to achieve the sharpness of a resulting color image, it is necessary that not only the fixing properties of the color toner are improved but also the charged condition of the color toner be controlled appropriately. Generally, in order to appropriately control the charged condition of the color toner, a charge control agent is added to the color toner.

However, it has been observed that, even when the charge control agent is added to the color toner as in the above-mentioned documents, the charge control agent does not serve to suitably control the charged condition of the toner over an extended period of time, and a defective fixing (e.g. fogging) of the color toner to the recording medium is caused, which will deteriorate the quality of a resulting color image.

According to the studies conducted by the present inventors, it is estimated that the negative ions of the infrared absorbent, contained in the color toner, gradually deteriorate the properties of the charge control agent with the passage of time and affect the charged condition of the toner over an extended period of time, which causes the deterioration of the quality of the resulting color image. Specifically, when the negative ions, such as perchloric acid ion ($ClO_4^-$), boron-fluoric acid ion ($BF_4^-$), trichloroacetic acid ion ($CCl_3COO^-$), trifluoroacetic acid ion ($CF_3COO^-$), picric acid ion ($(NO_2)_3C_6H_2O^-$), hexafluoro-bromic acid ion ($AsF_6^-$), hexafluoro-antimonic acid ion ($SbF_6^-$), benzensulfonic acid ion ($C_6H_5SO_3^-$), ethanesulfonic acid ion ($C_2H_5SO_3^-$), phosphoric acid ion ($PO_4^{2-}$), sulfuric acid ion ($SO_4^{2-}$) or chlorine ion ($Cl^-$), are used in the color toner together with the charge control agent, the negative ions serve to deteriorate the properties of the charge control agent to maintain the charged condition of the toner at the desired level.

Further, when the charge control agent is not added to the color toner and the charged condition of the color toner is suitably controlled without the charge control agent, there is the case in which the negative ions of the infrared absorbent, contained in the color toner, gradually affect the charged condition of the toner over an extended period of time.

SUMMARY OF THE INVENTION

It is an object of the present invention to provide an improved flash fixing color toner in which the above-described problems are eliminated.

Another object of the present invention is to provide a flash fixing color toner that provides the sharpness of a resulting color image with good toner fixing characteristics and good developing characteristics by using an infrared absorbent which does not lower the charged condition of the toner over an extended period of time.

Another object of the present invention is to provide an image forming process that provides the sharpness of a resulting color image with good toner fixing characteristics and good developing characteristics by using a flash fixing color toner including an infrared absorbent which does not lower the charged condition of the toner over an extended period of time.

The above-mentioned objects of the present invention are achieved by a flash fixing color toner for use in an image forming process, the color toner comprising a binder resin, a coloring agent, and an infrared absorbent, wherein negative ions form part of the infrared absorbent, and the negative ions include toluenesulfonic acid ion ($C_6H_4(CH_3)SO_3^-$), nitric acid ion ($NO_3^-$) or hexafluorophosphoric acid ion ($PF_6^-$).

The above-mentioned objects of the present invention are achieved by an image forming process, which is characterized by using a flash fixing color toner, the color toner comprising a binder resin, a coloring agent, and an infrared absorbent, the image forming process comprising the steps of: producing a toner image on a photoconductor by using the color toner; transferring the toner image from the photoconductor to a recording medium; and fixing the color toner to the recording medium by irradiation of flash light, so that a color image is formed on the recording medium, wherein negative ions form part of the infrared absorbent, and the negative ions include toluenesulfonic acid ion ($C_6H_4(CH_3)SO_3^-$), nitric acid ion ($NO_3^-$) or hexafluorophosphoric acid ion ($PF_6^-$).

According to the flash fixing color toner of the present invention, the negative ions of the infrared absorbent, including toluenesulfonic acid ion ($C_6H_4(CH_3)SO_3^-$), nitric acid ion ($NO_3^-$) or hexafluorophosphoric acid ion ($PF_6^-$), effectively prevent the lowering of the charged condition of the color toner over an extended period of time as in the conventional color toner. The stability of the charged condition of the color toner over an extended period of time is increased by the use of the infrared absorbent, and the flash fixing color toner and the image forming process of the present invention are effective in providing the sharpness of a resulting color image with good toner fixing characteristics and good developing characteristics.

Other objects, features and advantages of the present invention will become apparent from the following detailed description when read in conjunction with the accompanying drawings.

BRIEF DESCRIPTION OF THE DRAWINGS

FIG. 2 is a diagram for explaining examples of the infrared absorbent of the flash fixing color toner in which a diimmonium based infrared absorbent is used to alter the negative ions $X^-$.

FIG. 3 is a diagram for explaining examples of the infrared absorbent of the flash fixing color toner in which an aminium based infrared absorbent is used to alter the negative ions $X^-$.

FIG. 4 is a diagram for explaining examples of the infrared absorbent of the flash fixing color toner in which a polymethine based infrared absorbent is used to alter the negative ions $X^-$.

FIG. 5 is a diagram for explaining the results of evaluation of the examples of the flash fixing color toner of the invention containing the diimmonium based infrared absorbent as well as the comparative examples.

FIG. 6 is a diagram for explaining the results of evaluation of the examples of the flash fixing color toner of the invention containing the aminium based infrared absorbent as well as the comparative examples.

FIG. 7 is a diagram for explaining the results of evaluation of the examples of the flash fixing color toner of the invention containing the polymethine based infrared absorbent as well as the comparative examples.

DETAILED DESCRIPTION OF PREFERRED EMBODIMENTS

Figure 1:
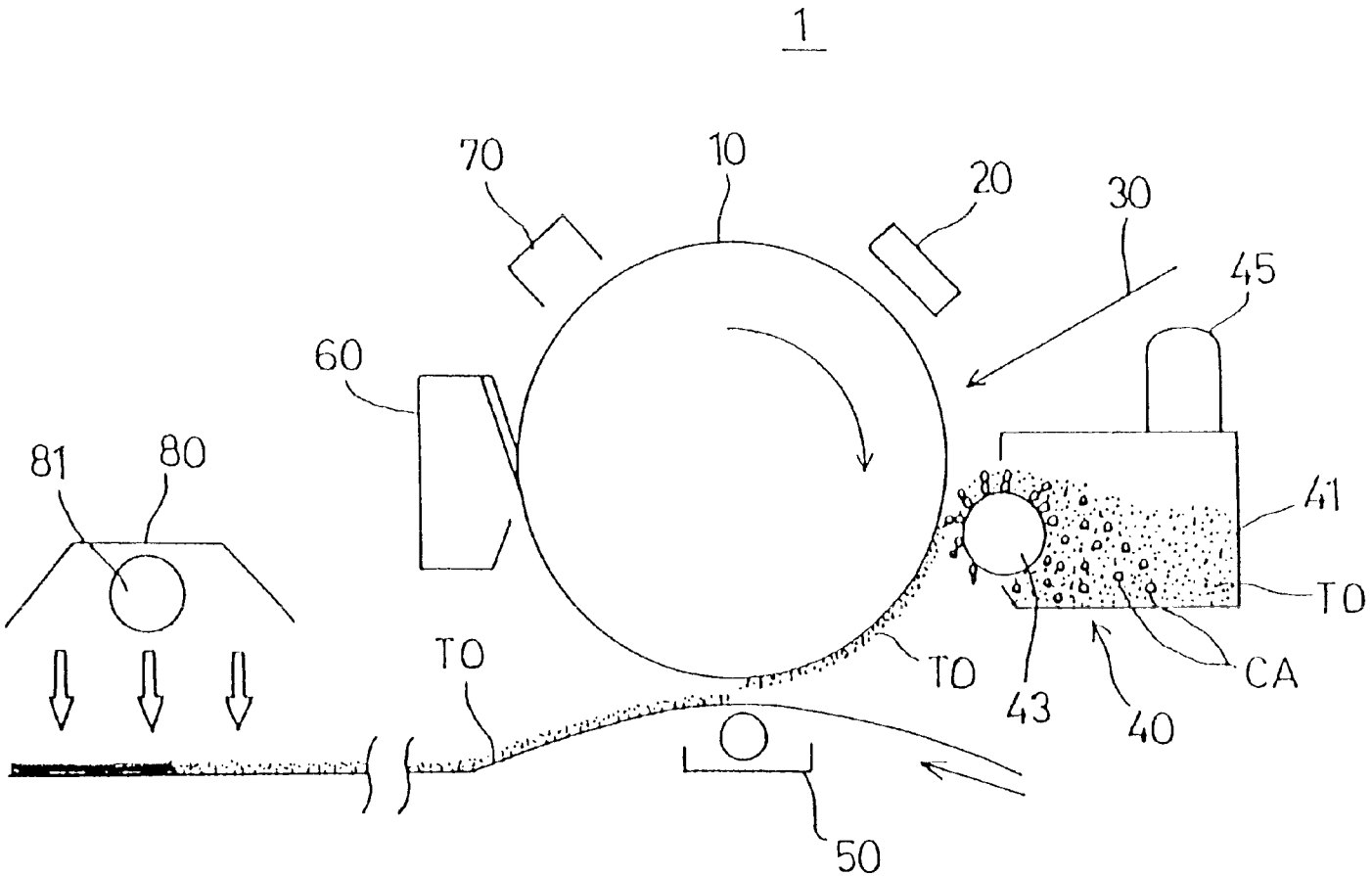
FIG. 1 is a schematic diagram of an image forming apparatus which uses a two-component developing agent.

A description will now be provided of the preferred embodiments of the present invention with reference to the accompanying drawings and working examples.

The flash fixing color toner according to the present invention essentially contains major components: a binder resin, a coloring agent and an infrared absorbent. When the necessity arises, a charge control agent is additionally contained in the color toner of the present invention. In the color toner of the present invention, negative ions form part of the infrared absorbent, and the negative ions of the infrared absorbent include toluenesulfonic acid ion ($C_6H_4(CH_3)SO_3^-$), nitric acid ion ($NO_3^-$) or hexafluorophosphoric acid ion ($PF_6^-$).

In one preferred embodiment of the flash fixing color toner of the present invention, the infrared absorbent comprises one of an aminium compound having a composition represented by the following formula (1), a diimmonium compound having a composition represented by the following formula (2), and a polymethine compound having a composition represented by the following formula (3), (1)

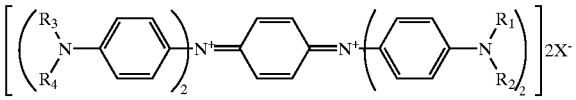

(2)

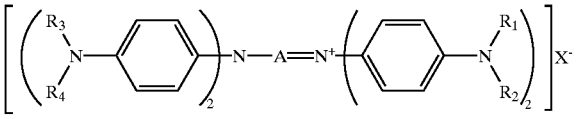

wherein, in the formulas (1) and (2), each of R1, R2, R3 and R4 represents hydrogen atom, an alkyl group, a substitution alkyl group, a cyclic alkyl group, an alkenyl group, an aralkyl group or a substitution aralkyl group, A represents a p-phenylene group or a p-biphenylene group, and $X^-$ represents the negative ions, (3)

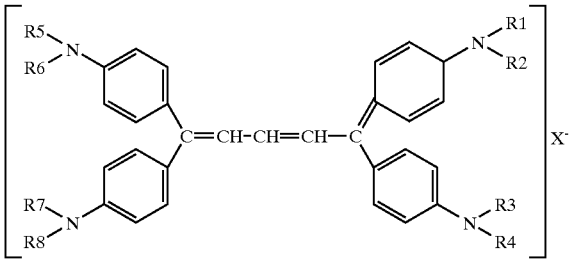

wherein, in the formula (3), each of R1, R2, R3, R4, R5, R6, R7 and R8 represents hydrogen atom, an alkyl group, a substitution alkyl group, a cyclic alkyl group, an alkenyl group, an aralkyl group or a substitution aralkyl group, and X represents the negative ions. The selected one of the aminium compound, the diimmonium compound or the polymethine compound in the infrared absorbent contained in the preferred embodiment of the color toner of the invention provides adequate infrared light energy absorption properties for the color toner, which allows the resulting color image to be stably fixed to the recording medium.

Further, one preferred embodiment of the flash fixing color toner of the present invention has a negative polarity charge. One preferred embodiment of the flash fixing color toner of the present invention further includes a charge control agent, and the color toner contains the charge control agent in the range of 0.1 to 5.0 parts by weight based on 100 parts by weight of the color toner. The preferred embodiment of the color toner of the invention is effective in providing adequate and stable charge characteristics of the color toner.

By the use of the infrared absorbent including the selected negative ions, it is possible for the color toner of the present invention to effectively prevent the lowering of the charged condition of the color toner over an extended period of time as in the conventional color toner. The stability of the charged condition of the color toner over an extended period of time is increased by the use of the infrared absorbent, and the flash fixing color toner of the present invention is effective in providing the sharpness of a resulting color image with good toner fixing characteristics and good developing characteristics.

A description will now be given of the respective components of the flash fixing color toner of the present invention.

Similar to the conventional color toner, the binder resin, such as a polyester resin, a styrene-acryl resin, an epoxy resin, a polyether-polyol resin, a urethane resin, a urea or a nylon, may be contained in the flash fixing color toner of the present invention. It is preferable that, among these resins, a polyester resin is contained as the binder resin for use in the flash fixing color toner of the present invention because the odor does not occur when fixing the color toner to the recording medium.

It is preferable that the alcohol component of the polyester resin includes 80 mol % or more of bisphenol-A alkylene oxide additives, and more preferably 95% or more of bisphenol-A alkylene oxide additives. If the content of the bisphenol-A alkylene oxide additives in the alcohol component is less than 80 mol %, the amount of monomers used becomes relatively large, which will cause the occurrence of the odor when fixing the toner.

The alcohol component of the above polyester resin, contained as the binder resin in the color toner of the present invention, may be bisphenol-A alkylene oxide additives, and the acid component of the polyester resin may be terephtalic acid or the like. Further, a bridge forming agent, such as a trimeric acid or the like, may be used.

The composition of the bisphenol-A alkylene oxide additives in the binder resin is represented by the following formula:

(4)

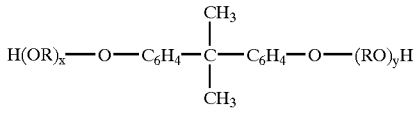

wherein, in the above formula (4), R represents an ethylene or propylene group, and each of x and y represents an integer that is larger than or equal to 1.

Examples of the alcohol component of the above polyester resin include polyoxypropylene-(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl) propane.

When the necessity arises, the alcohol component may include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol-A and hydrogenated bisphenol-A.

The tri- or poly-functional alcohol component may be contained to reduce offset. Examples of such alcohol component include sorbitol, 1,2,3,6-hexanetetrol, 1,4-sorbitan, pentaerythritol, dipentaerythritol, tripentaerithritol, 1,2,4-butanetriol, 1,2,5-pentanetriol, glycerol, 2-methypropanetriol, 2-methyl-1,2,4-butanetriol, trimethylolethane, trimethylolpropane, 1,3,5-trihydroxymethylbenzene, and other tri- and poly-hydroxylic alcohols.

Examples of the acid component of the above polyester resin include maleic acid, furamric acid, citraconic acid, itaconic acid, glutaric acid, phthalic acid, isophthalic acid, terephthalic acid, cyclohexanedicarboxylic acid, succinic acid, adipic acid, sebacic acid, azelaic acid, malonic acid, an anhydride thereof, a lower alkyl ester thereof and other dibasic carboxylic acids. Examples of the tri- and poly-basic carboxylic acid component, which may be contained as the bridge forming agent in the above polyester resin, include 1,2,4-benzene-tricarboxylic acid, 1,3,5-benzene-tricarboxylic acid, and other poly-basic carboxylic acids or anhydrides thereof.

Further, in order to accelerate formation of the above polyester resin, a commonly used esterification catalyst, such as zinc oxide, stannous oxide, dibutyl-tin-oxide or dibutyl-tin-dilaurate may be used.

A commonly used colorant may be contained as the coloring agent in the flash fixing color toner of the present invention.

Examples of the colorant that may be contained in the color toner of the present invention include aniline blue (C.I. No.50405), chalco oil blue (C.I. No. azoic blue3), chrome yellow (C.I. No.77103), ultramarine blue (C.I. No.77103), DuPont oil red (C.I. No.26105), quinoline yellow (C.I. No.47005), methylene blue chloride (C.I. No.52015), phthalocyanine blue (C.I. No.74160), halogenated phthalocyanine blue (C.I. No.74265/C.I. No.74255), malachite green oxalate (C.I. No.42000), lamp black (C.I. No.77266), rose bengal (C.I. No.45435), ECR-181 (Pg. No.122) and a mixture of these colorants.

In the flash fixing color toner of the present invention, the content of the above coloring agent is normally in the range of 0.1 to 20 parts by weight, based on 100 parts by weight of the color toner. It is preferable that the content of the above coloring agent in the flash fixing color toner of the present invention is in the range of 0.5 to 10 parts by weight based on 100 parts by weight of the color toner.

Further, as described above, in the flash fixing color toner of the present invention, the charge control agent may be additionally contained, similar to the conventional color toner. The charge control agent is dispersed in the above binder resin, and the charge control agent serves to control the charge amount of the color toner so as to be in a given range of the charge amount. When the binder resin is charged to the negative polarity, a negative-polarity charge control agent is used. When the binder resin is charged to the positive polarity, a positive-polarity charge control agent is used. Examples of the positive-polarity charge control agent include a nigrosin dye, a fourth class ammonium oxide and a triphenyl methane derivative. Examples of the negative-polarity charge control agent include a premetallized azo complex, a zinc naphthoic acid complex, a zinc salicylate complex and a calixarene compound. It is preferable that the color toner of the present invention has a negative polarity charge, and that the charge control agent contained in the color toner of the present invention is the negative-polarity charge control agent.

When the charge amount of the toner is too large, the amount of the toner attached to the photoconductor is excessively small, which will cause the optical density of the resulting color image on the recording medium to be excessively low. When the charge amount of the toner is too small, the amount of the toner attached to the photoconductor is excessively large or the toner is attached to an undesired portion of the photoconductor, which will cause the resulting color image to be defective. Therefore, in order to achieve appropriate quality of the resulting color image, it is important that the charge amount of the toner is controlled as being in the given range.

The content of the charge control agent in the color toner of the present invention can be arbitrarily set. However, if the content of the charge control agent is larger than 5.0 parts by weight based on 100 parts by weight of the color toner, the charge characteristics of the toner are liable to be unstable. If the content of the charge control agent is less than 0.1 parts by weight based on 100 parts by weight of the color toner, the charge characteristics of the toner are liable to be inadequate. Hence, it is preferable that the content of the charge control agent in the flash fixing color toner of the present invention is in the range of 0.1 to 5.0 parts by weight based on 100 parts by weight of the color toner.

Further, the infrared absorbent contained in the flash fixing color toner of the present invention will now be described.

It is preferable that the infrared absorbent contained in the flash fixing color toner of the present invention comprises, as the major component, positive ions of one of an aminium compound, a diimmonium compound and a polymethine compound. The above-mentioned positive ions are combined with the negative ions (which will be described later) which form part of the infrared absorbent, so that a salt-like compound is produced from the positive ions and the negative ions. The salt-form compound is mixed with the binder resin, the coloring agent and the charge control agent, and the mixture is dispersed in the color toner of the present invention.

In the infrared absorbent contained in the flash fixing color toner of the present invention, the aminium compound has a composition represented by the following formula (1), and the diimmonium compound has a composition represented by the following formula (2), (1)

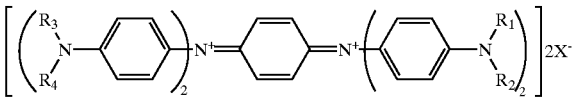

(2)

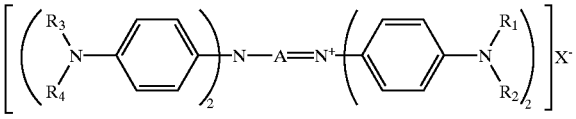

wherein, in the above formulas (1) and (2), each of R1, R2, R3 and R4 represents hydrogen atom, an alkyl group, a substitution alkyl group, a cyclic alkyl group, an alkenyl group, an aralkyl group or a substitution aralkyl group, A represents a p-phenylene group or a p-biphenylene group, and $X^-$ represents the negative ions.

Further, in the infrared absorbent contained in the flash fixing color toner of the present invention, the polymethine compound has a composition represented by the following formula (3), (3)

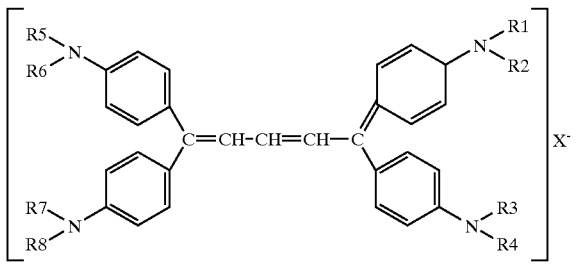

wherein, in the above formula (3), each of R1, R2, R3, R4, R5, R6, R7 and R8 represents hydrogen atom, an alkyl group, a substitution alkyl group, a cyclic alkyl group, an alkenyl group, an aralkyl group or a substitution aralkyl group, and $X^-$ represents the negative ions. The above three compounds may be contained solely or in combination in the infrared absorbent of the color toner of the present invention.

Regarding the R1, R2, R3, R4, R5, R6, R7 and R8 in the above formulas (1), (2) and (3), examples of the alkyl group include methyl group, ethyl group, n-propyl group, isopropyl group, n-butyl group, iso-butyl group, sec-butyl group, t-butyl group, n-pentyl group, iso-pentyl group, t-pentyl group, n-hexyl group, and n-octyl group. Examples of the substitution alkyl group include 2-hydroxyethyl group, 3-hydroxypropyle group, 4-hydroxybutyl group, 2-acetoxyethyl group, carboxymethyl group, 2-carboxyethyl group, 3-carboxypropyl group, 2-sulfoethyl group, 3-sulfopropyl group, 4-sulfobutyl group, 3-sulfatepropyl group, 4-sulfatebutyl group, N-(methylsulfonyl) carbamylmethyl group, 3-(acetylsulfanile)propyl group, and 4-(acetylsulfanile)propyl group. Examples of the cyclic alkyl group include cyclohexyl group. Examples of the alkenyl group include vinyl group, aryl group, and propenyl group. Examples of the aralkyl group include benzyl group, phenethyl group, α-naphthylmethyl group, and β-naphthylmethyl group. Examples of the substitution aralkyl group include carboxybenzyl group, sulfobenzyl group, and hydroxybenzyl group.

As described above, in the infrared absorbent contained in the flash fixing color toner of the present invention, the negative ions, which form the part of the infrared absorbent being combined with the above positive ions, include toluenesulfonic acid ion ($C_6H_4(CH_3)SO_3^-$), nitric acid ion ($NO_3^-$) or hexafluorophosphoric acid ion ($PF_6^-$). By the use of the infrared absorbent including the selected negative ions, it is possible for the color toner of the present invention to effectively prevent the lowering of the charged condition of the color toner over an extended period of time as in the conventional color toner. The stability of the charged condition of the color toner over an extended period of time is increased by the use of the infrared absorbent, and the flash fixing color toner of the present invention is effective in providing the sharpness of a resulting color image with good toner fixing characteristics and good developing characteristics.

However, it is not necessary that all the negative ions of the infrared absorbent are one of toluenesulfonic acid ion ($C_6H_4(CH_3)SO_3^-$), nitric acid ion ($NO_3^-$) and hexafluorophosphoric acid ion ($PF_6^-$). If the lowering of the properties of the charge control agent is avoided, the conventional infrared absorbent may be contained together with the above negative ions of the infrared absorbent of the present invention. For example, perchloric acid ion, antimony fluoride, phthalocyanine, or naphthalocyanine may be contained together with the above negative ions.

Further, the infrared absorbent of the present invention including the above negative ions may be contained in the color toner together with an inorganic infrared absorbent such as tin oxide, indium tin oxide, ytterbium compound. In such a case, a wide range of the infrared light energy absorption for the flash light can be covered by the infrared absorbent of the present invention and the inorganic infrared absorbent, and the desired infrared absorbing properties can be obtained.

In the flash fixing color toner of the present invention, a combination of some infrared absorbents may be used. From the point of view to achieve wide-range infrared light energy absorption properties and increased toner fixing properties, the use of a combination of the aminium based infrared absorbent and the polymethine based infrared absorbent is most suitable.

The content of the above infrared absorbent (both in the single case and the combined case) in the color toner of the present invention is normally in the range of 0.01 to 30 parts by weight based on 100 parts by weight of the toner. It is preferable that the content of the infrared absorbent in the color toner of the present invention is in the range of 0.5 to 5.0 parts by weight based on 100 parts by weight of the toner. If the content of the infrared absorbent is less than 0.01 parts by weight, the toner fixing characteristics will be inadequate. If the content of the infrared absorbent is larger than 30 parts by weight, the lowering of the charged condition of the toner over an extended period of time will occur, which may cause the occurrence of a defective fixing, such as fogging.

In the flash fixing color toner of the present invention, the fixing control agent, such as a polyethylene wax or a polypropylene wax, may be contained additionally. Further, the flowability control agent, such as white inorganic substance particles, may be contained together with the fixing control agent. The content of the flowability control agent in the color toner of the present invention is normally in the range of 0.01 to 5 parts by weight. It is preferable that the content of the flowability control agent in the color toner is in the range of 0.01 to 2.0 parts by weight. Examples of the flowability control agent include fine particles of silica, alumina, titanium oxide, barium titanate, magnesium titanate, calcium titanate, strontium titanate, zinc oxide, silica sand, clay, mica, silicide, diatom earth, chromium oxide, cerium oxide, iron oxide, antimony trioxide, magnesium oxide, zirconium oxide, barium sulfate, barium carbonate, calcium carbonate, silicon carbide, silicon nitride, and the like. In particular, fine particles of silica are more suitable for the above flowability control agent.

The fixing method used for the color toner of the present invention may be selected from the flash fixing method, the infrared ray fixing method and the halogen light fixing method. To achieve the long-term stability of the charged condition of the toner, the flash fixing method is more suitable for the color toner of the present invention.

The flash fixing color toner of the present invention may be provided as a one-component developing agent without the carrier. Alternatively, the flash fixing color toner of the present invention may be provided as a two-component developing agent by adding the carrier to the color toner. When the flash fixing color toner of the present invention is used as the two-component developing agent, it is preferable that a magnetite carrier, a ferrite carrier or an iron powder carrier is added to the color toner.

As described above, the flash fixing method can be performed, as one of the major steps of the electrophotographic image forming process, by using the flash fixing color toner of the present invention. In the flash fixing method, the color toner of the present invention is fixed to the recording medium by irradiation of flash light, so that a color image is created on the recording medium.

A description will be given of an image forming apparatus which carries out the electrophotographic image forming process by using the flash fixing color toner of the present invention.

FIG. 1 shows an image forming apparatus 1 which uses a two-component developing agent. The image forming apparatus 1 is configured with a high-speed developing capability (which has, for example, the process speed 1200 mm/s).

As shown in FIG. 1, in the image forming apparatus 1, a photoconductor 10 is provided, and the photoconductor 10 is made of amorphous silicon. A charger 20, a developing device 40, a transferring device 50, a cleaner 60, a charge removing device 70, and a flash fixing device 80 are arranged along the periphery of the photoconductor 10.

The charger 20 electrostatically charges the photoconductor 10. The photoconductor 10 is rotated in the direction indicated by the arrow in FIG. 1. The charged surface of the photoconductor 10 is exposed to an imaging light pattern 30 supplied by an exposure device (not shown), and an electrostatic latent image is created on the surface of the photoconductor 10. The developing device 40 develops the photoconductor 10 by bringing charged toner particles to the surface of the photoconductor 10 to create a toner image on the photoconductor surface. In the image forming apparatus 1, a recording medium (e.g., paper) is transported to the portion of the photoconductor 10 where the transferring device 50 is provided. The transferring device 50 transfers the toner image from the photoconductor surface to the recording medium. After the image transferring is performed, the recording medium is transported to the flash fixing device 80. The cleaner 60 cleans residual toner from the surface of the photoconductor 10, and the charge removing device 70 removes the charge from the surface of the photoconductor 10 so as to allow reinitiation of the above steps of the electrophotographic image forming process.

The flash fixing device 80 includes a xenon flash lamp 81. In the flash fixing device 80, the recording medium carrying the toner image is irradiated with flash light from the xenon flash lamp 81, so that the color toner is fixed to the recording medium.

The developing device 40 generally includes a developing agent container 41, a developing roller 43, stirring blades (not shown), and a developing agent supply portion 45. The two-component developing agent is supplied into the container 41 from the supply portion 45. In the developing agent container 41, the toner particles TO and the carrier particles CA are brought into contact with each other and a given quantity of charge is supplied to the toner. The two-component developing agent may use the carrier as the carrier component and the flash fixing color toner of the present invention as the toner component.

By carrying out the electrophotographic image forming process using the flash fixing color toner of the present invention in the image forming apparatus 1 described above, it is possible to provide the sharpness of a resulting color image with good toner fixing characteristics and good developing characteristics without causing the occurrence of fogging.

In the above-described embodiment, the photoconductor 10 is made of amorphous silicon. However, the material of the photoconductor 10 may be either an inorganic photoconductive material such as amorphous silicon or selenium, or an organic photoconductive material such as polysilane or phthalopolymethine. From the point of view of obtaining a long operative life of the photoconductor 10, it is preferable that the photoconductor 10 is made of amorphous silicon.

The present invention will now be described in detail with reference to the following examples of the flash fixing color toner. The following examples are not intended to limit the scope of the present invention.

The following examples are prepared as the two-component developing agent containing the carrier and the color toner, and the toner component is of the type containing the binder resin, the coloring agent, the infrared absorbent and the charge control agent.

The preparation of the carrier that is contained in each of the following examples will now be described. Magnetite particles with the particle size of about 60 $\mu$m are used as the carrier core, and, by using a fluidized bed, the surface of the carrier core is coated with 2% by weight of acrylic resin ("BR-85" made by Mitsubishi Rayon K.K.). The resulting carrier is dried, and the acrylic resin coated magnetite carrier is thus obtained.

The preparation of the polyester resin of the binder resin that is contained in each of the following examples will now be described. 1.0 mols of polyoxypropylene(2.2)-2,2-bis(4-hydroxyphenyl)propane, 9.0 mols of polyoxyethylene (2.2)-2,2-bis(4-hydroxyphenyl)propane, 4.6 mols of terephthalic acid, 4.6 mols of isophthalic acid, and 5.0 g of dibuthyl tin oxide are placed into a four-inlet flask. A thermometer, a stainless stirring bar, a drop-type condenser, and a nitrogen inlet pipe are attached to the flask. Under the flow of nitrogen gas in the inlet pipe, the flask is left in a mantle heater for three hours at 220 deg. C. and for three hours at 240 deg. C. Further, under the reduced pressure of 60 mmHg, the flask is left for two hours at 240 deg. C. The reaction of the source materials is caused in this manner, so that the polyester resin is produced.

FIG. 2, FIG. 3 and FIG. 4 show some examples of the infrared absorbent of the flash fixing color toner of the invention with the negative ions are altered, and comparative examples of the flash fixing color toner. Specifically, FIG. 2 shows examples of the infrared absorbent of the flash fixing color toner in which the diimmonium based infrared absorbent is used to alter the negative ions $X^-$, FIG. 3 shows examples of the infrared absorbent of the flash fixing color toner in which the aminium based infrared absorbent is used to alter the negative ions $X^-$, and FIG. 4 shows examples of the infrared absorbent of the flash fixing color toner in which the polymethine based infrared absorbent is used to alter the negative ions $X^-$.

Among the examples shown in FIG. 2 through FIG. 4, the first, second and third examples are the examples of the infrared absorbent of the color toner of the invention in which one of toluensulfonic acid ion, nitric acid ion and hexafluorophosphoric acid ion is used as the negative ions $X^-$, which form part of the infrared absorbent, and the remaining examples (the fourth and subsequent examples) are the comparative examples of the infrared absorbent. Specifically, the diimmonium1, the diimmonium2 and the diimmonium3, indicated in FIG. 2, the aminium1, the aminium2 and the aminium3, indicated in FIG. 3, and the polymethine1, the polymethine2 and the polymethine3, indicated in FIG. 4, are the examples of the infrared absorbent of the color toner of the invention. Other examples in FIG. 2 through FIG. 4 are the comparative examples of the infrared absorbent.

In each of FIG. 2, FIG. 3 and FIG. 4, "R1" through "R8", "A" and "$X^-$" indicated at the left end thereof are the same as corresponding elements of the above formulas (1) through (3).

FIG. 5, FIG. 6 and FIG. 7 show the results of evaluation of the examples of the color toner of the present invention as well as the comparative examples of the color toner. Specifically, the Example (EX.1), the Example2 (EX.2) and the Example3 (EX.3), indicated in FIG. 5, the Example (EX.11), the Example12 (EX.12) and the Example 13 (EX.13), indicated in FIG. 6, and the example19 (EX.19), the Example20 (EX.20) and the Example21 (EX.21), indicated in FIG. 7, are the examples of the color toner of the invention in which the infrared absorbent, shown in corresponding one of FIG. 2, FIG. 3 and FIG. 4, are used to alter the negative ions. Other examples (the Example4 through the Example10, the Example14 through the Example18, and the Example22 through the Example26) in FIG. 5 through FIG. 7 are the comparative examples of the color toner.

The preparation of the color toner that is contained in each of the following examples will now be described.

EXAMPLE 1 (EX.1)

As the source materials of the Example1, 1 part by weight of the diimmonium1 the composition of which is indicated in FIG. 2, 88 parts by weight of the above-mentioned polyester resin, 10 parts by weight of the coloring agent "KRT RED 304" (made by Dai Nippon Ink K.K.), 1 part by weight of the charge control agent "E-89" (made by Orient Kagaku K.K.), and 1 part by weight of the charge control agent "NP105" (made by Mitsui Kagaku K.K.) are placed into a mixer, and the source materials are mixed as a preliminary step by using the mixer. Then, the mixture is melted and uniformly dispersed by using an extruder, and the dispersed mixture is roughly divided by using a hammer mill, and it is finely divided by using a jet mill, and it is classified by means of an air classifier to obtain the base of the flash fixing color toner that is red-colored fine particles with the volume average particle size of about 8.5 $\mu$m. Finally, 1.5 parts by weight of fine particles of hydrophobic silica ("H2000/4" made by Kurarianto Japan K.K.) are externally added to the flash fixing color toner by using the mixer. The charge control agent "E-89" (made by Orient Kagaku K.K.) contained in the Example1 is a negative-polarity calixarene based compound.

EXAMPLE 2 (EX.2) THROUGH EXAMPLE 26 (EX.26)

Similar to the Example1, the Example2 through Example26 of the color toner that are red-colored fine particles with the volume average particle size of about 8.5 $\mu$m is obtained by using the corresponding infrared absorbent with the negative ions $X^-$ the composition of which is indicated in FIG. 2, FIG. 3 or FIG. 4. Further, 1.5 parts by weight of fine particles of hydrophobic silica ("H2000/4" made by Kurarianto Japan K.K.) are externally added to the flash fixing color toner by using the mixer.

In order to perform the evaluation of a resulting color image, the electrophotographic image forming process is performed by using the respective toners of the above examples and the comparative examples. The method of evaluation of a resulting color image and the results of the evaluation test will now be described.

The respective toners of the above examples and the comparative examples (the Example1 through the Example26) are provided as the two-component developing agent, and the carrier contained in the two-component developing agent is prepared as described above. Before performing the evaluation of the resulting color image with respect to each of the respective toners, 95.5% by weight of the carrier and 4.5% by weight of the toner are mixed to obtain the developing agent. The developing agent is incorporated into a high-speed flash fixation printer ("F6760D" made by Fijitsu Limited), and the electrophotographic printing process, including the toner flash fixing step, is carried out with the printer so that the resulting color image is formed on the recording medium with the developing agent. The items of the evaluation of the resulting color image include the fixing degree, the HH/LL charge amount ratio, the printed image optical density (LL/HH), and the fogging problem (LL/HH). The HH/LL charge amount ratio is indicated by a ratio of the HH charge amount of the toner in a given high-temperature high-humidity environment to the LL charge amount of the toner in a given low-temperature low-humidity (LL) environment.

(1) The evaluation of the resulting color image with respect to each of the respective toners is performed by using the high-speed flash fixation printer ("F6760D" made by Fijitsu Limited). The process speed of the printer is about 1200 mm/sec. The fixing degree of each toner (%), the HH charge amount of each toner (−μC./g), and the LL charge amount of each toner (−μC./g) are measured.

When measuring the fixing degree of each toner, a peel-off test is conducted for the resulting color image on the recording medium by using a mending tape (made by 3M K.K.). The tape is attached to the recording medium carrying the image by applying the load of 600 g, and the tape is peeled off the recording medium. The optical density of the residual image on the tape after the separation from the recording medium is measured by using a densitometer. The toner fixing degree is determined for each example by calculating a ratio of the optical density after the tape separation to the optical density before the tape separation. When the toner fixing degree is above 70%, it is concluded that the rating of evaluation of the example is good, which indicates the toner example shows good fixing characteristics.

(2) The charge amount of each toner is measured by using the magnet blow-off method. The HH charge amount of the toner in the high-temperature high-humidity (HH) environment (e.g., 32 deg. C. and 80% relative humidity) and the LL charge amount of the toner in the low-temperature low-humidity (LL) environment (e.g., 15 deg. C. and 20% relative humidity) are respectively measured. When the HH/LL charge amount ratio, calculated based on the measurements of the HH charge amount and the LL charge amount, is above 80%, it is concluded that the rating of evaluation of the example is good (indicated by "O" in FIG. 5 through FIG. 7), which indicates the example has good stability of the charged condition of the toner.

(3) The printed image optical density (LL/HH) is measured by using the Konica densitometer ("PDA-65"), and the evaluation of the optical density is performed after the printing of 1,000,000 copies is performed. When the optical density in each of the LL environment and the HH environment is above 1.30, it is concluded that the rating of evaluation of the example is good (indicated by "O" in FIG. 5 through FIG. 7). When the optical density in each of the LL environment and the HH environment is less than 1.30, it is concluded that the rating of evaluation of the example is poor (indicated by "X" in FIG. 5 through FIG. 7).

(4) In order to provide the sharpness of the resulting color image, it is necessary that the absolute value of the charge amount of the toner is in the range of 15 to 25 μC./g. If the absolute value of the charge amount of the toner is above 25 μC./g, the optical density will be too small. If the absolute value of the charge amount of the toner is below 15 μC./g, the resulting color image is liable to having the fogging problem. For each of the HH environment and the LL environment, it is determined whether the occurrence of fogging in the resulting color image can be seen by visual inspection. When the occurrence of fogging cannot be seen, it is concluded that the rating of evaluation of the example is good (indicated by "O" in FIG. 5 through FIG. 7). When the occurrence of fogging can be seen, it is concluded that the rating of evaluation of the example is poor (indicated by "X" in FIG. 5 through FIG. 7).

As is apparent from FIG. 5 through FIG. 7, all of the toner examples (EX.1 through EX.26) meet the fixing degree requirement, which is above 70%, which is needed for providing good fixing characteristics of the color toner. It is estimated that the infrared absorbent (including the aminium based compound, the diimmonium compound or the polymethine compound), contained in the respective examples, provides adequate infrared light energy absorption properties for the color toner, which allows the resulting color image to be stably fixed to the recording medium.

Further, as shown in FIG. 5 through FIG. 7, the Example1, the Example2 and the Example3 (including the infrared absorbent with the selected negative ions based on the diimmonium1, the diimmonium2 or the diimmonium3) indicated in FIG. 5, the Example11, the Example12 and the Example13 (including the infrared absorbent with the selected negative ions based on the aminium1, the aminium2 or the aminium3) indicated in FIG. 6, and the Example19, the Example20 and the Example21(including the infrared absorbent with the selected negative ions based on the polymethine1, the polymethine2 or the polymethine3) indicated in FIG. 7 show that the absolute value of the charge amount of the toner in each of the LL environment and the HH environment is in the range of 15 to 25 μC./g. The above-mentioned examples of the color toner of the present invention show that they have good stability of the charged condition of the toner (the HH/LL charge amount ratio of each toner is above 80%), that they have adequate printed image optical density, and that they have no fogging problem. Therefore, it is confirmed that the above-mentioned examples of the color toner of the present invention are effective in providing the sharpness of the resulting color image with good toner fixing characteristics and good developing characteristics.

However, as shown in FIG. 5 through FIG. 7, the comparative examples of the color toner indicate that they are liable to having an excessively charged condition of the toner in the LL environment, and liable to having an insufficiently charged condition of the toner in the HH environment. It is estimated that the negative ions in the infrared absorbents in the comparative examples, which include perchloric ions ($ClO_4^-$), boron-fluoric acid ions ($BF_4^-$) or the like, serve to deteriorate the properties of the charge control agent to maintain the charged condition of the toner at the desired level, as previously described.

As described in the foregoing, the flash fixing color toner of the present invention contains the infrared absorbent including the selected negative ions $X^-$ based on toluenesulfonic acid ion ($C_6H_4(CH_3)SO_3^-$), nitric acid ion ($NO_3^-$) or hexafluorophosphoric acid ion ($PF_6^-$), and therefore, it is possible for the color toner of the present invention to effectively prevent the lowering of the charged condition of the toner over an extended period of time by the use of the infrared absorbent including the selected negative ions. The stability of the charged condition of the toner over an extended period of time is increased by the use of the infrared absorbent, and the flash fixing color toner of the present invention is effective in providing the sharpness of the resulting color image with good fixing characteristics and good developing characteristics.

The present invention is not limited to the above-described embodiments, and variations and modifications may be made without departing from the scope of the present invention.

In the above-described examples of the flash fixing color toner of the present invention, the charge control agent is contained in order to maintain the charged condition of the toner at the desired level. However, the present invention is not limited to these examples. There is the case in which the charged condition of the toner can be suitably maintained by using the color toner containing only the basic components: the binder resin, the coloring agent, and the infrared absorbent. In such a case, the selected negative ions of the infrared absorbent, such as toluensulfonic acid ion, nitric acid ion or hexafluorophosphoric acid ion, effectively prevent the lowering of the charged condition of the toner over an extended period of time as in the conventional color toner.

Further, the present invention is based on Japanese priority application No.2000-379344, filed on Dec. 13, 2000, the entire contents of which are hereby incorporated by reference.

What is claimed is:

1. A flash fixing color toner for use in an image forming process, the color toner consisting of a binder resin, a coloring agent, and an infrared absorbent, wherein negative ions form part of the infrared absorbent, and the negative ions include toluenesulfonic acid ion ($C_6H_4(CH_3)SO_3^-$) or nitric acid ion ($NO_3^-$).

2. The color toner as claimed in claim 1, wherein the infrared absorbent comprises one of the group consisting of an aminium compound and a diimmonium compound, wherein the aminium compound has a composition represented by the following formula (1), and the diimmonium compound has a composition represented by the following formula (2), (1)

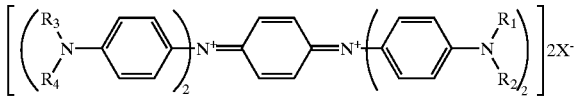

-continued (2)

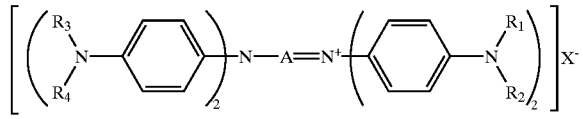

and wherein, in the formulas (1) and (2), each of R1, R2, R3 and R4 represents hydrogen atom, an alkyl group, a substitution alkyl group, a cyclic alkyl group, an alkenyl group, an aralkyl group or a substitution aralkyl group, A represents a p-phenylene group or a p-biphenylene group, and $X^-$ represents the negative ions.

3. The color toner as claimed in claim 1, wherein the color toner has a negative polarity charge.

4. A flash fixing color toner for use in an image forming process, the color toner consisting of a binder resin, a charge control agent, a coloring agent, and an infrared absorbent, wherein negative ions form part of the infrared absorbent, and the negative ions include toluenesulfonic acid ion ($C_6H_4(CH_3)SO_3^-$) or nitric acid ion ($NO_3^-$);

and further wherein the color toner contains the charge control agent in a range of 0.1 to 5.0 parts by weight based on 100 parts by weight of the color toner;

and further wherein the color toner has a negative polarity charge.

5. An image forming process, which is characterized by using a flash fixing color toner, the color toner consisting of a binder resin, a coloring agent, and an infrared absorbent, the image forming process comprising the steps of:

producing a toner image on a photoconductor by using the color toner;

transferring the toner image from the photoconductor to a recording medium; and fixing the color toner to the recording medium by irradiation of flash light, so that a color image is formed on the recording medium, wherein negative ions form part of the infrared absorbent, and the negative ions include toluenesulfonic acid ion ($C_6H_4(CH_3)SO_3^-$) or nitric acid ion ($NO_3^-$).

* * * * *